US009289066B2

(12) United States Patent
Wallace

(10) Patent No.: US 9,289,066 B2
(45) Date of Patent: Mar. 22, 2016

(54) BOOSTER SEAT FOR A BARBER CHAIR

(71) Applicant: Semaj Jauron Wallace, Miami Gardens, FL (US)

(72) Inventor: Semaj Jauron Wallace, Miami Gardens, FL (US)

( * ) Notice: Subject to any disclaimer, the term of this patent is extended or adjusted under 35 U.S.C. 154(b) by 0 days.

(21) Appl. No.: 14/517,316

(22) Filed: Oct. 17, 2014

(65) Prior Publication Data

US 2015/0108807 A1 Apr. 23, 2015

Related U.S. Application Data

(60) Provisional application No. 61/892,829, filed on Oct. 18, 2013.

(51) Int. Cl.

| | |
|---|---|
| ***A47C 1/04*** | (2006.01) |
| ***A47C 1/06*** | (2006.01) |
| ***A47C 1/08*** | (2006.01) |
| ***A47D 1/10*** | (2006.01) |
| ***A47C 1/11*** | (2006.01) |

(52) U.S. Cl.
CPC .... *A47C 1/06* (2013.01); *A47C 1/11* (2013.01)

(58) Field of Classification Search
CPC ..... A47C 1/06; A47C 1/11; A47D 1/004
USPC ..... 297/236, 256.16, 344.15, 232
See application file for complete search history.

(56) References Cited

U.S. PATENT DOCUMENTS

| | | | | | |
|---|---|---|---|---|---|
| 1,063,809 | A * | 6/1913 | Lawson | 297/236 X | |
| 1,357,469 | A * | 11/1920 | Palmer | 297/237 | |
| 1,368,802 | A * | 2/1921 | Johnson | A47C 1/11 | 297/155 |
| 1,630,432 | A * | 5/1927 | Hydorn | A47C 1/11 | 297/232 |
| 2,058,299 | A * | 10/1936 | Cook | 297/236 X | |
| 2,665,746 | A * | 1/1954 | Darter | A47C 1/11 | 297/232 |
| 2,743,766 | A * | 5/1956 | Bartman | 297/232 X | |
| 3,022,037 | A * | 2/1962 | Stallard | 248/421 | |
| 4,025,107 | A * | 5/1977 | Chippa | 297/344.15 X | |
| 4,032,103 | A * | 6/1977 | Ehrichs | 248/421 | |
| 4,461,444 | A * | 7/1984 | Grassl et al. | 297/344.15 X | |
| 4,768,827 | A * | 9/1988 | Musgrove | 297/236 | |
| 5,074,619 | A * | 12/1991 | D'Orsi et al. | 297/236 | |
| 6,431,109 | B1 * | 8/2002 | Martin | 297/344.12 X | |
| 6,644,737 | B2 * | 11/2003 | Kohl et al. | 297/344.15 X | |
| 6,672,659 | B1 * | 1/2004 | Melohn et al. | 297/236 X | |
| 7,021,713 | B2 * | 4/2006 | Kao et al. | 297/339 | |
| 8,292,368 | B1 * | 10/2012 | Yarbrough | 297/344.15 X | |
| 8,360,524 | B2 * | 1/2013 | Deml et al. | 297/344.15 | |
| 8,733,829 | B2 * | 5/2014 | Liu et al. | 297/119 | |
| 8,936,306 | B2 * | 1/2015 | Liu et al. | 297/344.15 X | |
| 2003/0011229 | A1 * | 1/2003 | Bell | 297/344.17 | |
| 2012/0139306 | A1 * | 6/2012 | Jeong et al. | 297/344.15 X | |
| 2013/0341984 | A1 * | 12/2013 | Olesen | 297/344.15 | |
| 2015/0028643 | A1 * | 1/2015 | Reborse | 297/344.15 X | |
| 2015/0108810 | A1 * | 4/2015 | Hyder et al. | 297/344.15 | |

FOREIGN PATENT DOCUMENTS

| | | | | |
|---|---|---|---|---|
| GB | 2275183 A * | 8/1994 | A47C 16/02 | |

* cited by examiner

*Primary Examiner* — Rodney B White

(57) ABSTRACT

A booster seat apparatus mounted to a chair is provided. The booster seat apparatus may include a lift assembly with a seat pad. The chair may be a salon or barber chair and may include a chair base frame, a chair back substantially perpendicular to the chair base frame, and a foot rest extending downward from the chair base frame. The lift assembly includes an expanded position and a compressed position. The expanded position includes an increased distance between the seat pad and the chair base frame, and the compressed position includes a decreased distance between the seat pad and the chair base frame. Therefore, a child may be boosted upward on the chair without the need of an extra booster seat.

6 Claims, 4 Drawing Sheets

BOOSTER SEAT FOR A BARBER CHAIR

CROSS-REFERENCE TO RELATED APPLICATION

This application claims the benefit of priority of U.S. provisional application No. 61/892,829, filed Oct. 18, 2013, the contents of which are herein incorporated by reference.

BACKGROUND OF THE INVENTION

The present invention relates to barber chairs and, more particularly, to a booster seat for a barber chair.

A barber chair is a chair for customers to a barber or hairdresser. A smaller person or child may need a booster seat while sitting in the barber chair. Booster seats only provide a single level of increased height. Typically booster seats wear down and tear within one to two years. Further, when all of the boosters are in use at a barber shop and additional booster seats are needed, the business is negatively affected.

As can be seen, there is a need for an improved booster seat for a barber chair.

SUMMARY OF THE INVENTION

In one aspect of the present invention, a booster salon chair comprises: a chair base frame; a chair back substantially perpendicular to the chair base frame; a lift assembly attached to the chair base frame; and a seat pad attached to the lift assembly, wherein the lift assembly comprises an expanded position and a compressed position, wherein the expanded position comprises an increased distance between the seat pad and the chair base frame, and the compressed p comprises a decreased distance between the seat pad and the chair base frame.

In another aspect of the present invention, a booster seat apparatus comprises: a lower frame; an upper frame comprising a seat pad; and a lift frame attaching the lower frame and the upper frame together, and operable to alter a distance between the lower frame and the upper frame, wherein the lift frame comprises at least a first cross bar and a second cross bar each comprising a first end and a second end, wherein the first end of the first cross bar is pivotally attached to the lower frame and the first end of the second cross bar is pivotally attached to the upper frame, wherein the first and second cross bar are pivotally attached to one another at a crossing point.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a booster seat incorporated into a Salon/Barber chair. By attaching a scissor lift mechanism underneath the seat cushion of the chair and to the frame underneath the seat, the present invention elevates the seat cushion to at least two different height levels for added comfort, convenience. Further, the present invention is economical, space saving and time preserving and includes a design that is not offered by other boosters.

Figure 1:
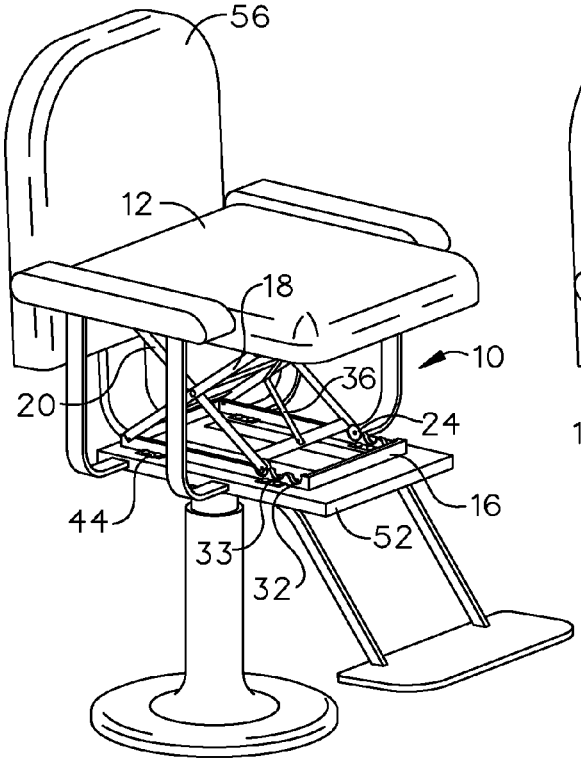
FIG. 1 is a perspective view of the present invention, shown in use, with the seat in the expanded position.
Figure 2:
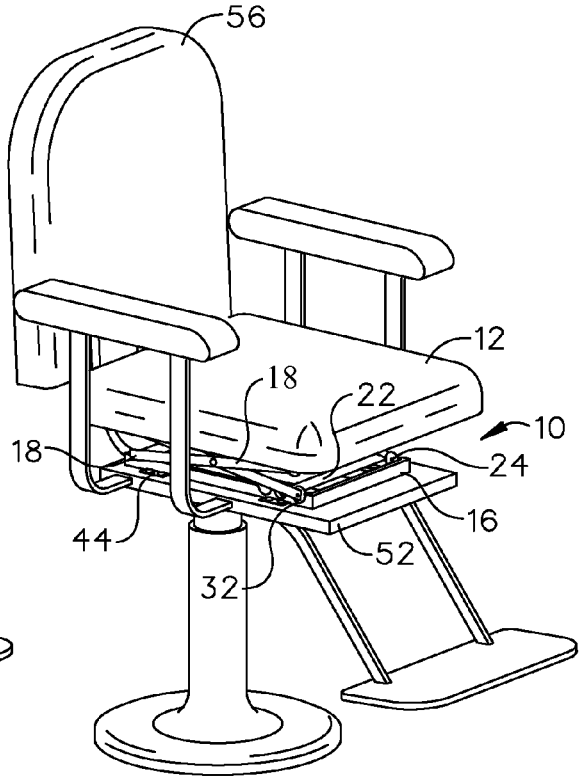
FIG. 2 is a perspective view of the present invention, shown in use, with the seat in the compressed position.
Figure 3:
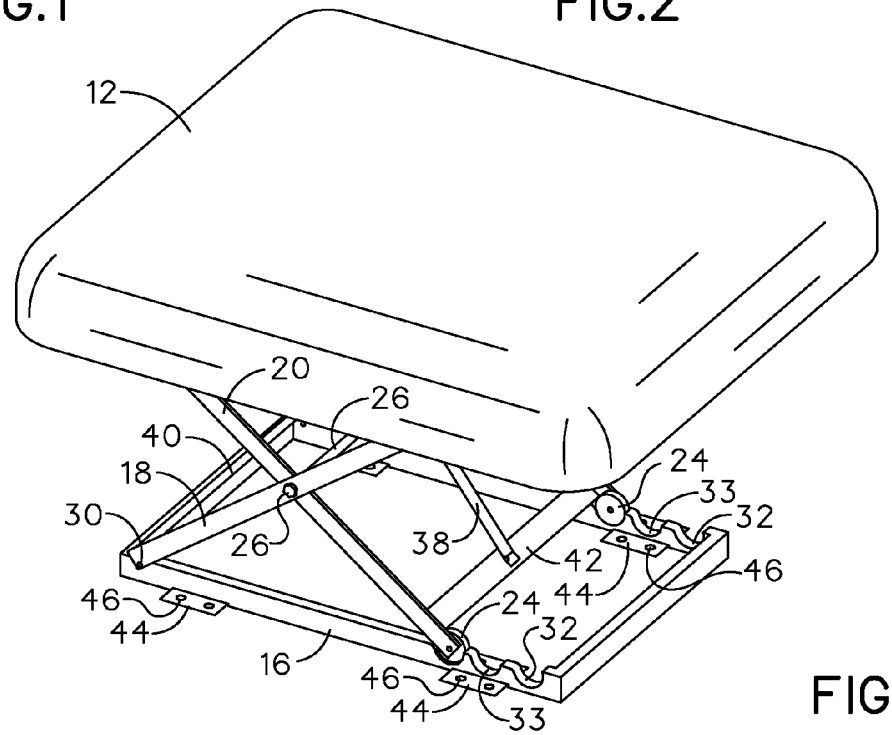
FIG. 3 is a perspective view of booster seat apparatus of the present invention.
Figure 4:
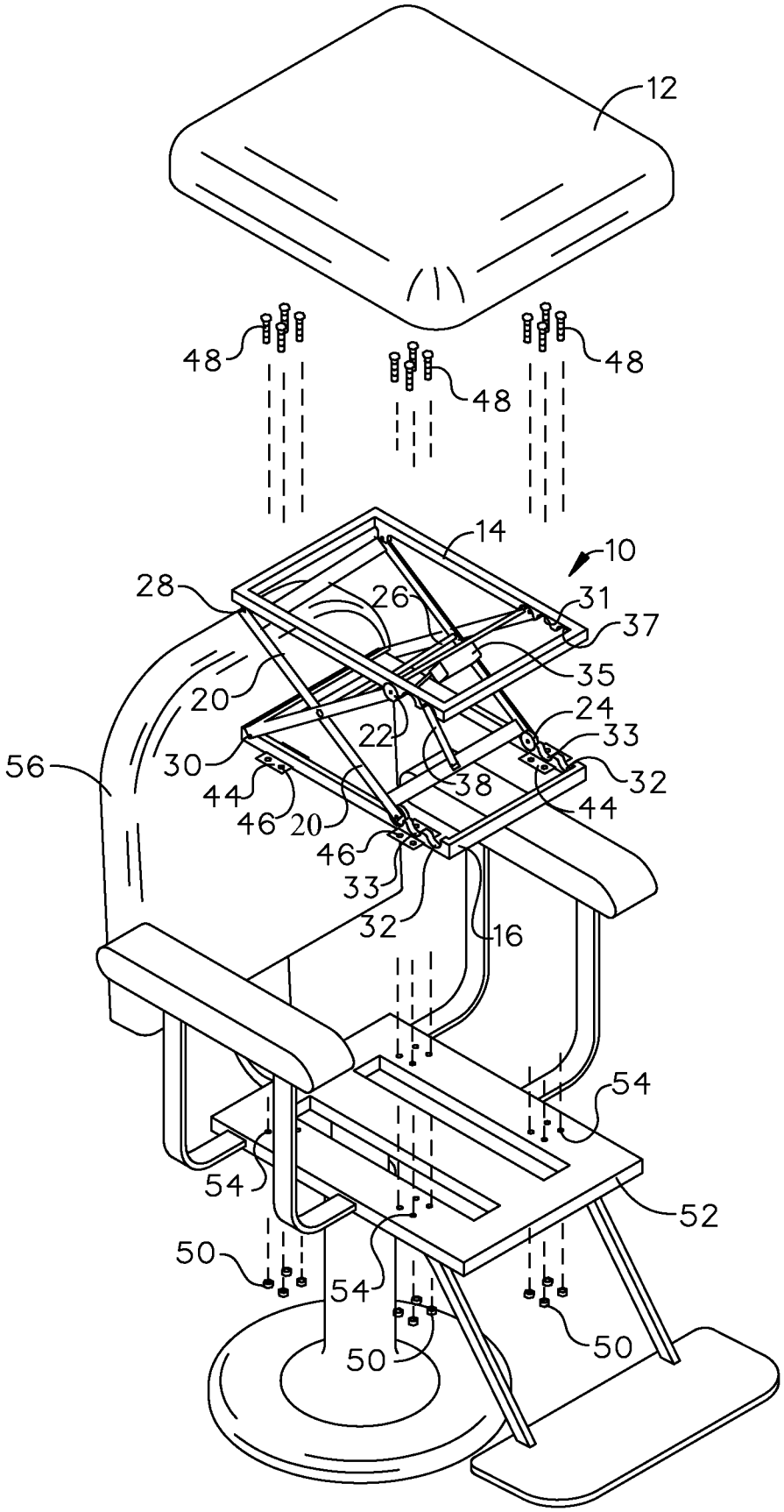
FIG. 4 is an exploded view of the present invention.
Figure 5:
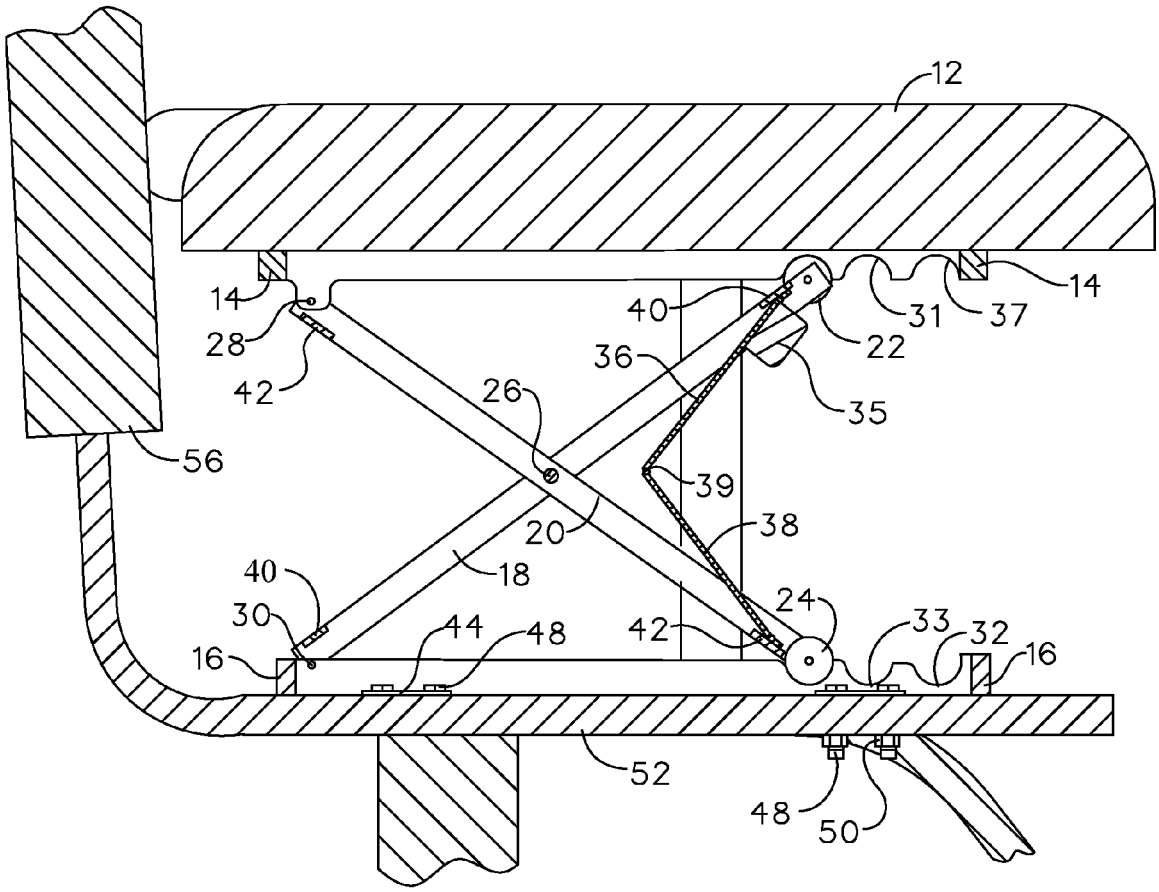
FIG. 5 is a section view of the present invention, taken along line 4-4 in FIG. 1.
Figure 6:
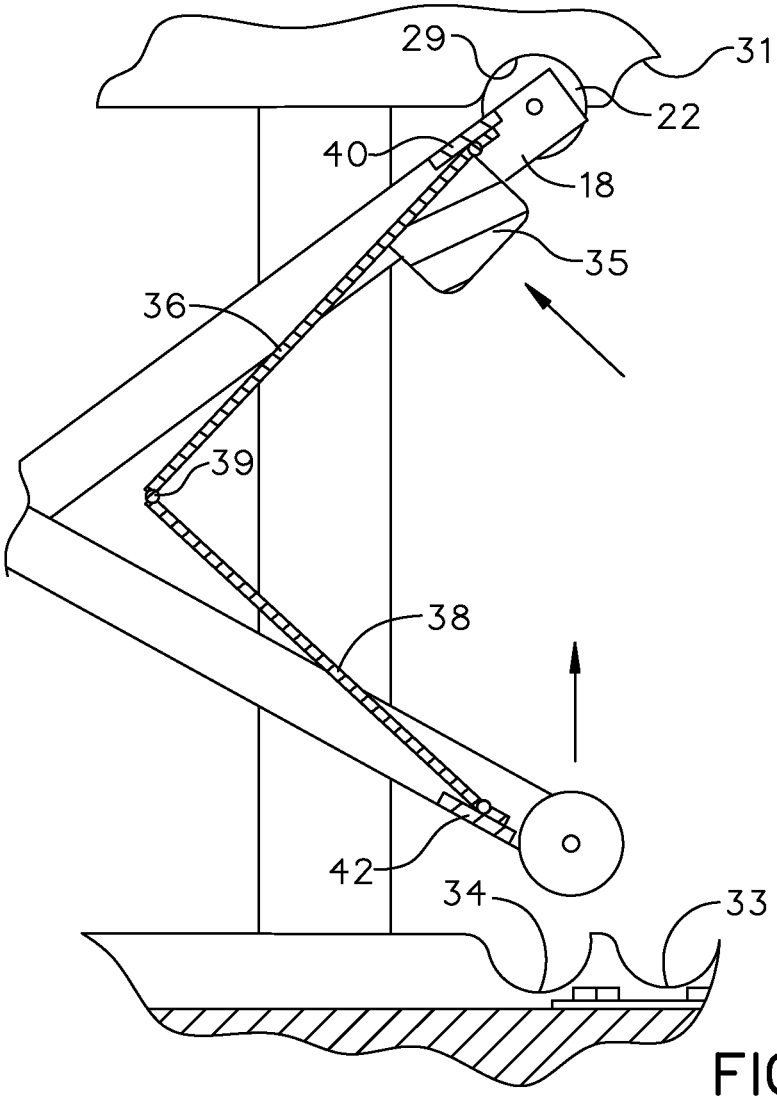
FIG. 6 is a detail section view of the present invention, illustrating the pivoting of the release bars.
Figure 7:
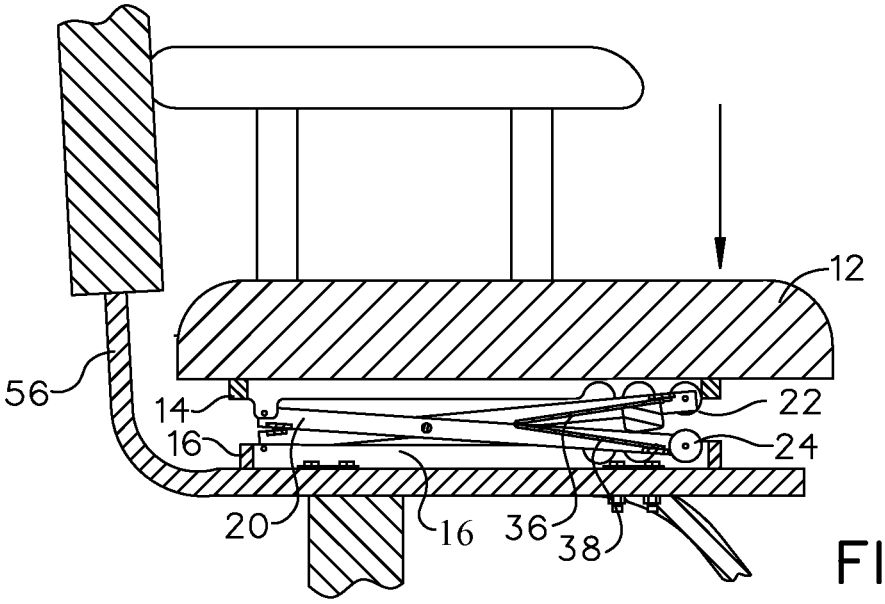
FIG. 7 is a section view of the present invention, illustrating the lowering of the lift assembly.

Referring to FIGS. 1 through 7, the present invention may include a booster seat apparatus mounted to a chair. The booster seat apparatus may include a lift assembly 10 with a seat pad 12. The chair may be a salon or barber chair and may include a chair base frame 52, a chair back 56 substantially perpendicular to the chair base frame 52, and a foot rest extending downward from the chair base frame 52. The lift assembly 10 includes an expanded position and a compressed position. The expanded position includes an increased distance between the seat pad 12 and the chair base frame 52, and the compressed position includes a decreased distance between the seat pad 12 and the chair base frame 52. Therefore, a child may be boosted upward on the chair without the need of an extra booster seat.

The lift assembly 10 of the present invention may include pivoting members, telescoping members, and the like to raise and lower the seat pad 12. In certain embodiments, the lift assembly 10 may include an upper frame 14 and a lower frame 16. The seat pad 12 may be attached to the upper frame 14. A lift frame may attach the lower frame 16 to the upper frame 14 and is operable to alter a distance between the lower frame 16 and the upper frame 14

In certain embodiments, the lift frame may include a pair of first cross bars 18 and a pair of second cross bars 20. The first cross bars 18 and the second cross bars 20 may each include a first end and a second end. The first end of a first cross bar 18 is pivotally attached to the lower frame 16 at pivot point 30 and the first end of a second cross bar 20 is pivotally attached to the upper frame 14 at pivot point 28 on each side of the lift assembly 10. The first and second cross bars 18, 20 are pivotally attached to one another at a crossing pivot point 26. The pair of first cross bars 18 may be connected to one another by first connector bars 40 at the first ends and the second ends. The pair of second cross bars 20 may be connected to one another by second connector bars 42 at the first ends and second ends.

In certain embodiments, the pair of first cross bars 18 and the pair of second cross bars 20 slidably engage with the upper and lower frames 14, 16, and thereby slidabily engaging the lift assembly 10 in between the expanded and contracted positions. In such embodiments, the second ends of the first cross bars 18 may slidably engage with the top frame 14 and the second ends of the second cross bars 20 may slidably engage with the bottom frame 16. In certain embodiments, the cross bars 20 may slidably engage with the frames 14, 16 via rollers 22, 24. The first cross bars 18 may include upper rollers 22 and the second cross bars 20 may include lower rollers 24.

Utilizing the above disclosed rollers, 22, 24 the lift assembly 10 may be altered from the compressed position to the expanded position, and back the compressed position. In certain embodiments, there may be more than one tier of expanded positions, thereby allowing users to make multiple adjustments to the height of the seat pad 12. For example, the present invention may include a compressed position, a middle expanded position, and a fully expanded position. In such embodiments, the lower frame 16 may include a plurality of notches 32, 33, 34, formed to receive and secure the second rollers 24 within. The plurality of notches 32, 33, 34 may include a compressed position notch 32, a middle expanded notch 33, and a fully expanded notch 34. The rollers 24 may be secured within each notch 32, 33, 34 to secure the lift assembly 10 within the respective position.

In certain embodiments, the upper frame 14 may be substantially straight without notches. In certain embodiments, the upper frame 14 may include corresponding notches 29, 31, 37 to further secure the lift assembly 10 in the compressed position, a middle expanded position, and a fully expanded position. The corresponding of notches 29, 31, 37 may also include a compressed position notch 29, a middle expanded notch 31, and a fully expanded notch 37.

The present invention may be changed from the compressed position to the expanded position by mechanical means, a hydraulic pressure booster mechanism, a racking booster mechanism, air pressure, an electric lift mechanism, a retractable pole lift mechanism and the like. In certain embodiments, the present invention may include a handle assembly in order to grasp the lift assembly 10 and alter the lift assembly 10 to a different position. In such embodiments, the handle assembly may include a lower release bar 38 and an upper release bar 36. The lower release bar 38 may be attached to a second connector bar 40, and the upper release bar 38 may be attached to a first connector bar 42 on the front side of the lift assembly 10. The lower release bar 38 may be pivotally attached to the upper release bar 36 at pivot point 39. A handle 35 may be attached to the upper release bar 36. Therefore, a user may grasp the handle 35 and lift the second rollers 24 out of a notch 32, 33, 34 and place the second rollers 24 into a different notch 32, 33, 34 to alter the position of the lift assembly 10.

The booster seat apparatus of the present invention may be attached to a chair or alternatively may rest on the chair and thereby may be easily removed. When the booster seat apparatus is attached, the lower frame 16 of the lift assembly 10 may include connecting brackets 44 with bracket apertures 46. The chair base frame 52 may include frame apertures 54 that align with the bracket apertures 46. Bolts 48 may be placed through the aligned bracket apertures 46 and the frame apertures 54. Nuts 50 may be secured to the bolts 48, thereby securing the lift assembly 10 to the salon or barber chair.

While in use, the lift assembly 10 may be in the compressed position for an average sized adult. While in the compressed position, the lower rollers 24 may be secured within the compressed position notches 32. For an older child, the handle 35 may be grasped, and the lower rollers 24 may be lifted out of the compressed position notches 32. The upper rollers 22 may roll along the upper frame 14, and the lower rollers 24 may be lowered into the middle expanded notch 33 to lift the seat 12 to the middle expanded position. For a younger child, the handle 35 may be grasped and the lower rollers 24 may be lifted out of the middle expanded notch 33. The upper rollers 22 may roll along the upper frame 14 and lower rollers 24 may be lowered into the fully expanded notch 34 to lift the seat 12 to the fully expanded position. The seat 12 may be lowered by moving the lower rollers 24 back to the compressed position notches 32 using the method described above.

It should be understood, of course, that the foregoing relates to exemplary embodiments of the invention and that modifications may be made without departing from the spirit and scope of the invention as set forth in the following claims.

What is claimed is:

1. A booster salon chair comprising:

a chair base frame;

a chair back substantially perpendicular to the chair base frame;

a lift assembly comprising a lower frame, an upper frame, and a lift frame, wherein the lift frame comprises a pair of first crossbars and a pair of second crossbars each crossbar comprising a first end and a second end, wherein the first ends of the first pair of crossbars are pivotally attached to the lower frame and the first ends of the second pair of cross bars are pivotally attached to the upper frame, wherein the second ends of the first pair of cross bars are slidably engaged with the top frame, and the second ends of the second pair of cross bars are slidably engaged with the lower frame, wherein the pair of first cross bars are connected by at least a first connector bar near the second ends of the pair of first cross bars, and wherein the pair of second cross bars are connected to one another by at least a second connector bar near the second ends of the pair of second cross bars, wherein the lower frame and the upper frame are substantially parallel with one another, and wherein the lower frame is mounted to the chair base frame;

a seat pad attached to the upper frame of the lift assembly; and a handle assembly comprising a lower release bar attached to the second connector bar and an upper release bar attached to the first connector bar, wherein the lower and upper release bars are pivotally attached to one another, and a handle is attached to the upper release bar, wherein the lift assembly comprises an expanded position and a compressed position, wherein the expanded position comprises an increased distance between the seat pad and the chair base frame, and the compressed position comprises a decreased distance between the seat pad and the chair base frame.

2. The booster salon chair of claim 1, wherein the second ends of each of the pair of first cross bars comprises a first roller, and the second ends of each of the pair of second cross bars comprises a second roller.

3. The booster salon chair of claim 2, wherein the lower frame comprises a plurality of notches formed to receive and secure the second rollers within.

4. A booster seat apparatus comprising:

a lower frame;

an upper frame comprising a seat pad; and a lift frame attaching the lower frame and the upper frame together, and operable to alter a distance between the lower frame and the upper frame, wherein the lift frame comprises a pair of first cross bars and a pair of second cross bars each cross bar comprising a first end and a second end, wherein the first end of the first pair of cross bars is pivotally attached to the lower frame and the first end of the second pair of cross bars is pivotally attached to the upper frame, wherein the second end of the first pair of cross bars is slidably engaged with the top frame, and the second end of the second pair of cross bars is slidably engaged with the lower frame, wherein the pair of first cross bars is connected by at least a first connector bar near the second ends of the pair of first cross bars, and wherein the pair of second cross bars are connected to one another by at least a second connector bar near the second ends of the pair of second cross bars; and a handle assembly comprising a lower release bar attached to the second connector bar and an upper release bar attached to the first connector bar, wherein the lower and upper release bars are pivotally attached to one another, and a handle is attached to the upper release bar.

5. The booster salon chair of claim 4, wherein the second ends of the first pair of cross bars each comprise a first roller, and the second ends of the second pair of cross bars each comprise a second roller.

6. The booster salon chair of claim 5, wherein the lower frame comprises a plurality of notches formed to receive and secure the second rollers within.

* * * * *